US006209831B1

(12) United States Patent
Kiplinger et al.

(10) Patent No.: US 6,209,831 B1
(45) Date of Patent: Apr. 3, 2001

(54) PRODUCT SUPPORT HOOK FOR USE IN ELECTRONIC PRODUCT INFORMATION DISPLAY SYSTEM

(75) Inventors: Kenneth M. Kiplinger, Tipp City; Antonio Lopez, Troy, both of OH (US)

(73) Assignee: Display Edge Technology Ltd., Troy, OH (US)

( * ) Notice: Subject to any disclaimer, the term of this patent is extended or adjusted under 35 U.S.C. 154(b) by 0 days.

(21) Appl. No.: 09/256,799

(22) Filed: Feb. 24, 1999

(51) Int. Cl.[7] ..... A47B 96/06; G09F 3/00

(52) U.S. Cl. ..... 248/220.31; 211/59.1; 40/642.01

(58) Field of Search ..... 248/220.31, 220.41, 248/220.42, 225.21, 304, 339; 211/59.1, 59.2; 40/642.01, 655

(56) References Cited

U.S. PATENT DOCUMENTS

| | | | | |
|---|---|---|---|---|
| D. 312,959 | | 12/1990 | Hamann | D8/367 |
| D. 378,050 | | 2/1997 | Richeson | D8/367 |
| 4,500,880 | * | 2/1985 | Gomersall et al. | 340/825.35 |
| 4,783,033 | * | 11/1988 | Valiulis | 248/220.22 |
| 4,850,557 | * | 7/1989 | Valiulis | 248/220.22 |
| 5,111,196 | * | 5/1992 | Hunt | 340/825.35 |
| 5,236,163 | * | 8/1993 | Valiulis | 248/220.41 |
| 5,375,725 | | 12/1994 | Rosenthal | 211/59.1 |
| 5,537,126 | | 7/1996 | Kayser et al. | 345/1 |
| 5,711,432 | | 1/1998 | Stein et al. | 211/57.1 |
| 5,736,967 | | 4/1998 | Kayser et al. | 341/1 |
| 5,751,257 | * | 5/1998 | Sutherland | 345/2 |
| 5,815,970 | | 10/1998 | Thalenfeld et al. | 40/642.01 |
| 5,816,696 | * | 10/1998 | Beisler | 362/396 |
| 5,860,239 | * | 1/1999 | Thalenfeld et al. | 40/642.01 |
| 5,939,984 | * | 8/1999 | Brady et al. | 340/572.1 |

FOREIGN PATENT DOCUMENTS

| | | | |
|---|---|---|---|
| 2249854 | * | 5/1992 | (GB) . |
| 9927824 | | 6/1999 | (WO) . |

OTHER PUBLICATIONS

PCT International Search Report; PCT Application No. PCT/US00/40037; filed on Feb. 22, 2000.

* cited by examiner

*Primary Examiner*—Anita M. King
(74) *Attorney, Agent, or Firm*—Thompson Hine & Flory LLP

(57) ABSTRACT

A display system adapted for use in combination with one or more electronic display tags is provided and includes a mounting panel having a plurality of openings therein forming at least one line of spaced openings. A conductive member is positioned adjacent the mounting panel and extends along at least a portion of the line of spaced openings. An elongated peg hook frame has a display end and an attachment end. The peg hook frame includes an elongated product support adapted at its front end to receive products for support and display thereof, and an elongated information display support having an attachment surface at its front end for receiving an electronic display tag. The rear end of the peg hook frame includes at least one hook-type member which is positioned within one of the spaced openings of the mounting panel. A coil is positioned at the rear end of the peg hook frame so as to be proximate to the conductive member for inductive coupling therewith and may be wound about a magnetic core for increasing such inductive coupling.

21 Claims, 7 Drawing Sheets

PRODUCT SUPPORT HOOK FOR USE IN ELECTRONIC PRODUCT INFORMATION DISPLAY SYSTEM

TECHNICAL FIELD

The present invention relates generally to electronic product information display systems, and more particularly to a product support and electronic information display device adapted for attachment to a mounting panel having a plurality of mount openings therein, and a related electronic display system.

BACKGROUND

The concept of electronic product information display systems is becoming more and more popular. For example, a system which utilizes an inductive coupling technique to provide power and information to a plurality of electronic display tags is disclosed in U.S. Pat. Nos. 5,537,126 and 5,736,967. Other types of electronic product information display systems utilize RF communication between the electronic display tags and a controller.

The advent of such electronic product information display systems has generated an expanding need for devices suited for implementing such display systems in a wide variety of display structures. For example, existing stores tend to have many different types of product display shelves, stands, racks, rails, etc. One type of product display structure commonly used for smaller items is a mounting panel in the form of a wall board having a plurality of holes or openings therein which are adapted to receive hook type members, commonly referred to as peg hooks, from which products can be hung. The flexibility of such arrangements is advantageous, but in the context of electronic product information display systems the problem lies in the absence of the typical shelf front rail to which electronic display tags have been connected in the past.

Accordingly, it would be desirable and advantageous to provide an electronic product information display system compatible with the mounting panel/peg hook type product display structure. Further, it would be desirable and advantageous to provide a product support and information display device adapted for attachment to a mounting panel and adapted for use with an electronic display tag.

SUMMARY OF THE INVENTION

In one aspect of the present invention a display system adapted for use in combination with one or more electronic display tags is provided and includes a mounting panel having a plurality of openings therein forming at least one line of spaced openings. A conductor is positioned adjacent the mounting panel and extends along at least a portion of the line of spaced openings. An elongated peg hook frame has a front end and a rear end. The rear end of the peg hook frame includes at least one hook-type member which is positioned within one of the spaced openings of the mounting panel. A coil is positioned at the rear end of the peg hook frame so as to be proximate to the conductor for inductive coupling therewith.

An electronic display tag may be positioned on a front portion of the peg hook frame with a pair of lead wires extending from the tag to the coil which may be wound about a magnetic core. The leads provide information signals to the display tag for controlling the display of information thereby. The leads may also provide power to the electronic display tag, if necessary, as taught in U.S. Pat. Nos. 5,537,126 and 5,736,967. Advantageously, the display hook may be removed from the mounting panel for repositioning thereon as desired to provide product support and electronic display information at another location.

In another aspect of the present invention, a product support and electronic product information display device adapted for attachment to a mounting panel having a plurality of mount openings therein is provided and includes an elongated peg hook frame having a front end and a rear end. The rear end of the peg hook frame includes at least one hook-type member for positioning within one of the mount openings of the mounting panel to support the peg hook frame therefrom. An electronic display tag is pivotally connected to the peg hook frame to enable selection of a display angle of the display tag.

In embodiments adapted for inductive communication with a controller, the rear end may also include a magnetic core with a coil wound thereon and leads extending from the coil to the tag. In order to assure that the magnetic core and/or coil is properly positioned adjacent a conductive member extending along the mounting panel, an appropriate biasing mechanism or urging mechanism may also be provided at the rear end of the peg hook frame to aid in pressing the magnetic core in a rearward direction. Again, the subject device provides an electronic display of product information while at the same time permitting simple reorganization within a peg hook type display system.

Advantageously, the electronic display tag may also be pivotally mounted to the information display support to permit selection of a display angle of the display tag when the peg hook frame is positioned on the mounting panel.

DETAILED DESCRIPTION

Figure 1:
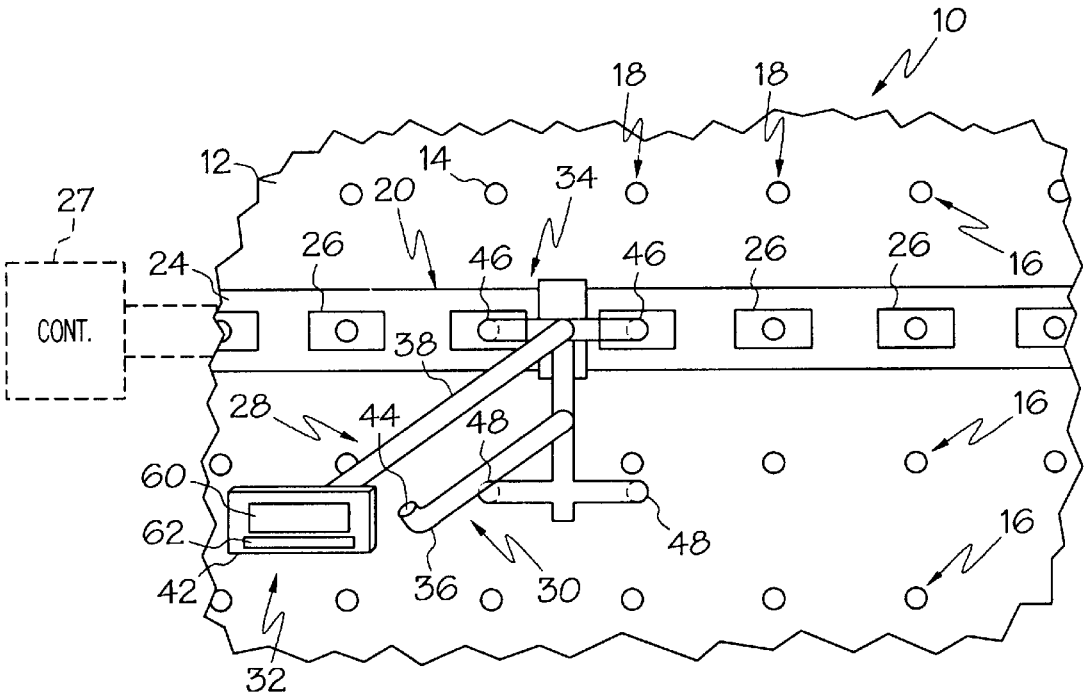
FIG. 1 is a partial perspective view of one embodiment of a display system in accordance with the present invention.
Figure 2:
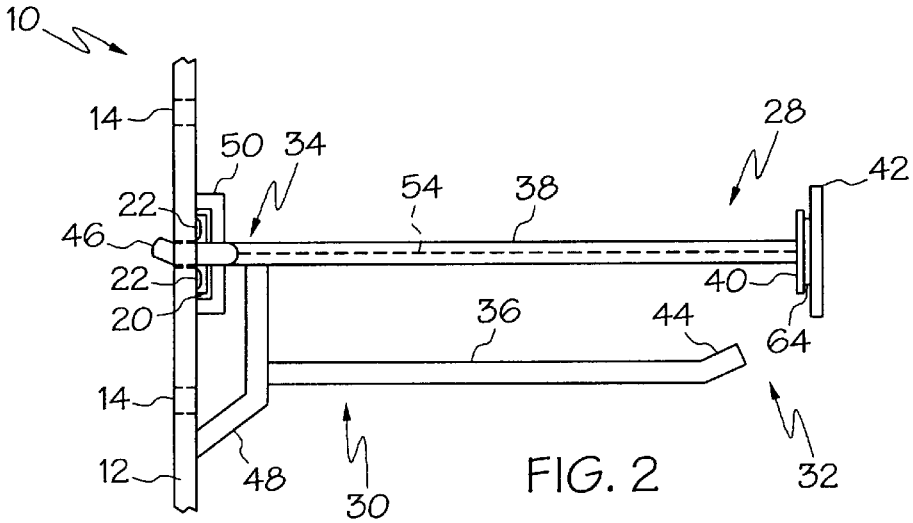
FIG. 2 is a partial side elevation view of the display system of FIG. 1.

Referring to the drawings, FIGS. 1 and 2 illustrate one embodiment of a display system 10 in accordance with the present invention having a mounting panel 12 having a plurality of holes or openings 14 formed therethrough. Mounting panel 12 may be formed of any suitable material such as plastic, wood, processed wood/paper fibers such as masonite, or even metal. In a typical peg hook type display system mounting panel 12 is commonly referred to as a peg board or wall board and the term mounting panel is intended to cover such structures as well as variations thereof suited to the invention. The openings 14 on the mounting panel are generally spaced equidistant from each other and form a plurality of rows 16 and columns 18 of spaced openings. A conductive member 20 is positioned against the mounting panel and extends along at least a portion of one of the rows 16 of spaced openings 14 as shown. It is likewise recognized that the conductive member 20 could extend along one of the columns 18 of spaced openings 14 and that multiple conductive members could be provided on a given mounting panel.

In the illustrated embodiment conductive member 20 is formed by a pair of spaced, flat rectangular electrically conductive strips 22 which are housed within an electrically insulating material 24 such as a semi-rigid plastic housing or coating. The conductive member 20 may be secured to the mounting panel 12 by any suitable means such as an adhesive, screws, nails, clips, or other fasteners. In the preferred embodiment, the conductive member 20 is mounted in a semi-permanent manner which allows it to be moved to another location on the mounting panel 12 if necessary or desired during a reorganization of the product display system 10. However, the conductive member 20 could be positioned on the rear side of the mounting panel 12 or could be formed integrally within the mounting panel 12. Further, a single conductor could be utilized.

The insulating casing 24 of the conductive member 20 includes a plurality of spaced openings 26 therethrough in the region between the spaced conductors 22. The openings 26 are preferably spaced similarly to the openings 14 on the mounting panel 12 to facilitate alignment of the respective openings 26 and 14 as shown. However, it is recognized that other spacings of the openings 26 are possible. The electronic product information display system includes a controller 27 configured to communicate with a multiplicity of electronic display tags, and the conductor or conductors 22 are operatively connected to the controller 27, as shown schematically, for receiving signals therefrom. The controller 27 may be an individual controller or may be formed by multiple interrelated controllers such as the area controller and system controller described in U.S. Pat. Nos. 5,537,126 and 5,736,967.

A product and information display support 28 is provided in the form of an elongated peg hook frame 30 having a front end 32 and a rear end 34. The peg hook frame 30 includes an elongated product support 36 and an elongated information display support 38. The information display support 38 includes an attachment surface 40 at its front end for receiving an electronic display tag 42. The elongated product support 36 is adapted at its front end to receive products for the support and display thereof in a sequential manner along its length. For example, the front end of product support 36 angles slightly upward at 44 to aid in preventing packages or products supported thereon from sliding off of the product support 36 unless pulled, for example by a customer.

The rear end of peg hook frame 30 includes two hook-type members, 46 each positioned within and through a respective opening 14 within the mounting panel 12, and likewise through the conductive member opening 26 aligned therewith. Spaced stabilizing feet or legs 48 may also be provided at the lower rear portion of the peg hook frame 30 so as to abut against the surface of the mounting panel 12. Alternatively, the stabilizing legs 48 could be positioned for insertion into respective openings 14. The peg hook frame 30 may be formed by individual metallic rod or tubular members which are bent as necessary and welded together. However, it is recognized that other materials could be used to form the peg hook frame 30 including wood or even plastic, in which case the peg hook frame 30 could be formed as an integral molded unit. It is also recognized that the product support 36, the information display support 38, and the other portions of the peg hook frame 30 could take on other shapes aside from the tubular shapes shown, such as elongated rectangular members or elongated plate-like structures. Further, while the product support 36 and information display support 38 are shown extending generally horizontal from the mounting panel 12, it is recognized and contemplated that such supports could extend at some predetermined angle, either upward or downward as desired.

Figure 3:
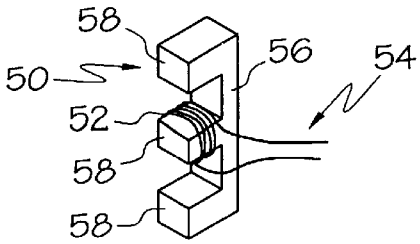
FIG. 3 is an enlarged perspective view of a magnetic core and associated coil utilized in the display system of FIG. 1.

The peg hook frame 30 includes a magnetic core member 50 positioned at its rear end 34 so as to be proximate to the conductive member 20 when peg hook frame 30 is attached to the mounting panel 12. A coil 52 (FIG. 3) wound around the magnetic core 50 has lead wires 54 which extend forward toward the front end of the peg hook frame and particularly to the attachment surface of the information display support 38 for connection to the electronic display tag 42. Where information display support 38 is a hollow tubular member, it is anticipated that lead wires 54 could extend within the tubular member along a substantial portion of the length thereof before exiting the member to connect to the electronic display tag 42. However, the lead wires 54 could also extend along the outer surface of the information display support 38 or, in the case of a molded plastic peg hook frame 30, the lead wires 54 could be molded integrally within the product support 38.

The coil 52 is provided for inductive coupling with the conductor or conductors 22. The primary significance of the magnetic core 50 is to facilitate or increase inductive coupling between the coil 52 and the conductors 22 of the conductive member 20. The term "magnetic core" refers generally to any structure having a relatively high magnetic permeability which would tend to increase inductive coupling between the conductor or conductors 22 and the coil 52. In this regard, in the preferred embodiment the magnetic core 50 includes a base portion 56 having prongs 58 which extend therefrom, with the end prongs 58 being positioned adjacent to the outside (in this configuration top or bottom) of a respective one of the spaced conductors 22 while the intermediate prong 58 is positioned between the spaced conductors 22. However, it is recognized that other magnetic core configurations could be utilized. Electrical information and/or power signals transmitted along the conductors 22 are thus communicated to the electronic display tag 42 by inductive coupling of such signals to the coil 52 on the magnetic core 50.

The electronic display tag 42 includes a display screen 60 for displaying product information such as the total price or price per unit weight of the product positioned on the product support 36. The front face of the electronic display tag 42 may also include one or more printed labels 62 adhesively attached thereto for conveying additional product information to potential consumers. Internally the display tag may include display driver circuitry such as a microcontroller or ASIC, switch means, input circuitry for receiving power and information signals, and output circuitry for effecting communication with the controller 27. An adhesive member such as a double-sided adhesive foam 64 may be used to secure the electronic display tag 42 to the attachment face 40 of the information display support 38. However, it is also recognized that other means of attaching the tag 42 to the product support 38 may be utilized, such as a fastener-type arrangement or through the use of an attachment face 40 structured to receive the display tag 42 in a snap-fit type manner.

Figure 4:
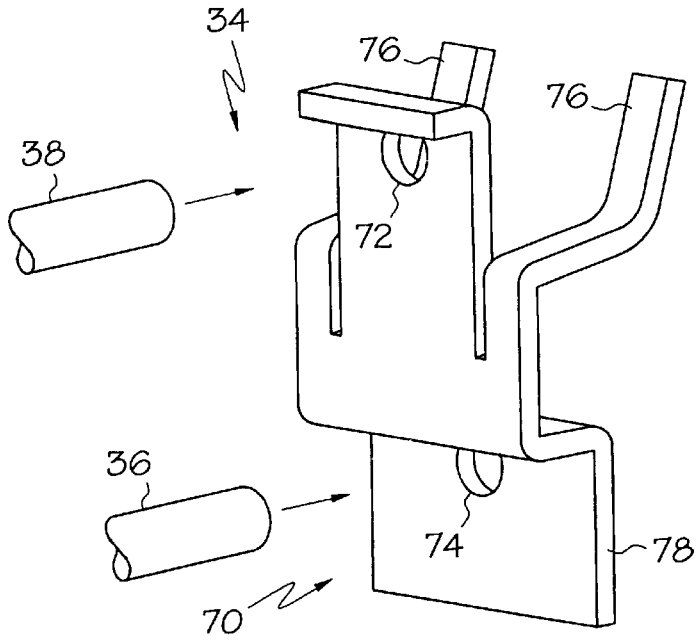
FIG. 4 is a partial perspective, exploded view of the rear end of one embodiment of a peg hook frame for use in the display system of FIG. 1.
Figure 5A:
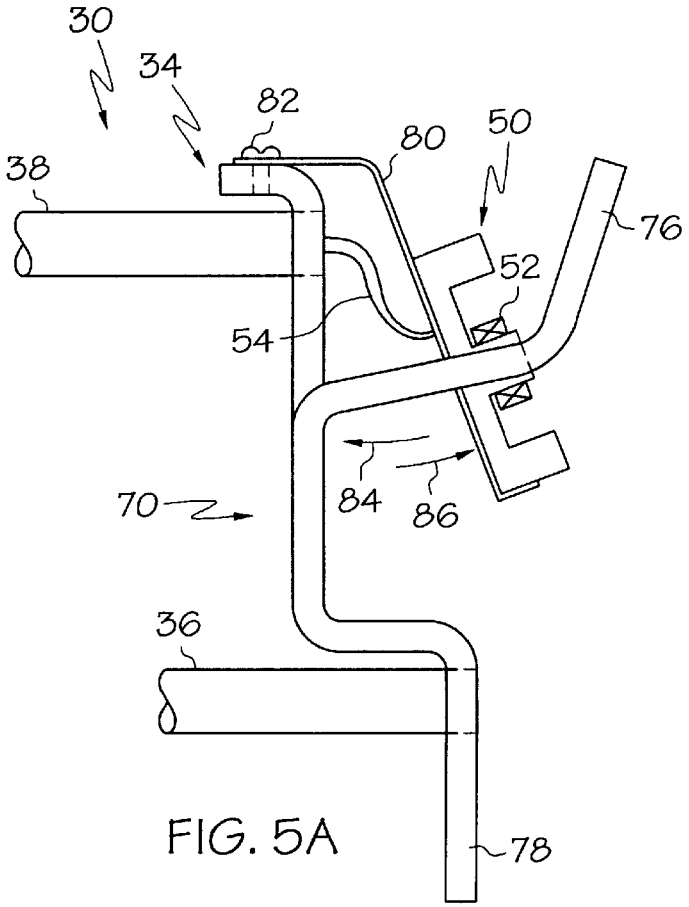
FIGS. 5A–5C are partial side elevation views of the rear ends of peg hook frames incorporating magnetic core mount structures.
Figure 5B:
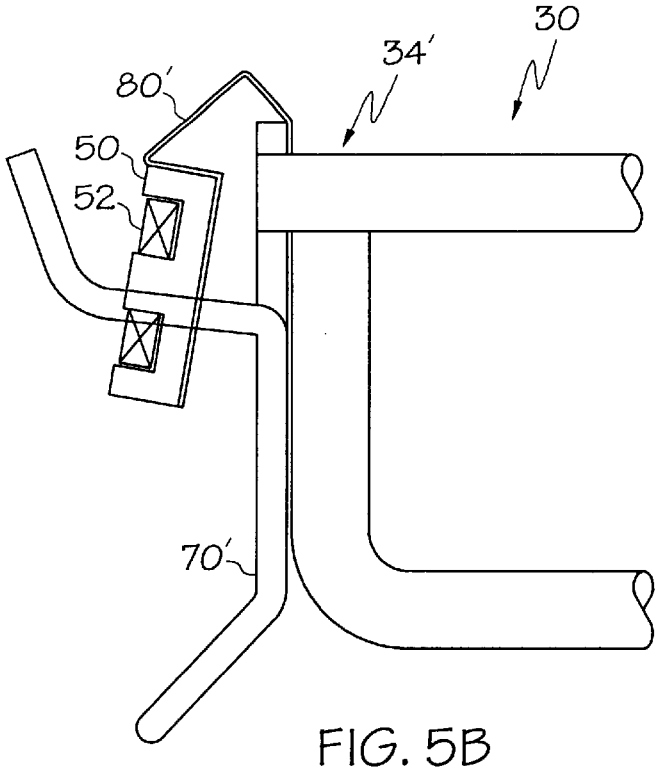
Figure 5C:
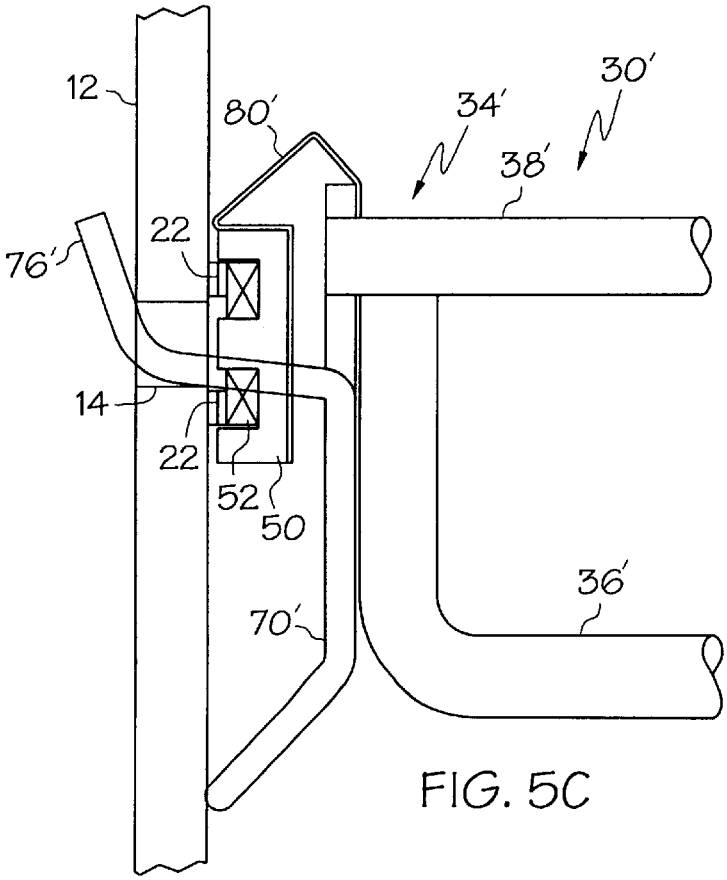

Referring now to FIG. 4 in which an exploded perspective view of the rear portion of another embodiment of a peg hook frame is shown, a bracket 70 includes openings 72 and 74 positioned and spaced for attachment to the rear end of information display support 38 and product support 36 respectively. Such attachment could be achieved by welding or other suitable means. The bracket 70 includes spaced hooks 76 for positioning within the openings 14 of the mounting panel 12, and a stabilizing plate 78 the rear side of which is positioned to abut against the surface of the mounting panel 12. A side elevation view of the bracket 70 as connected to the supports 36 and 38 is shown in FIG. 5A. While the magnetic core 50 could be rigidly secured to the rear portion of the peg hook frame 30, in one preferred embodiment the magnetic core 50 is mounted in a movable manner and so as to be urged in the rearward direction when the peg hook frame 30 is positioned on the mounting panel 12. One example of such a connection is shown in FIG. 5A in which a leaf-spring type member 80 is secured to the bracket 70 at one end by one or more screws 82 with the magnetic core 50 being secured toward the other end of the leaf spring 80. It is recognized that leaf spring 80 could be connected to the bracket 70 in some other manner, such as by welding. The leaf spring 80 is movable in the frontward direction indicated by arrow 84 when the magnetic core 50 comes into contact with the surface of the mounting panel 12 and when so moved the leaf spring 80 maintains a resilience which tends to push the magnetic core 50 in the rearward direction indicated by arrow 86 so as to assure that the magnetic core 50 abuts against the mounting panel 12 and/or the conductor or conductors 22 extending along the mounting panel 12. An alternative leaf spring 80' and bracket 70' configuration is shown in FIGS. 5B–5C, with FIG. 5B showing the rear end 34' of a peg hook frame 30' before connection to a mounting panel. FIG. 5C shows the rear end 34' of the peg hook frame 30', including support 36 and 38 after connection with the mounting panel 12, using hook 76' the magnetic core 50 and coil 52 being urged by the leaf spring 80' into the illustrated position adjacent the conductors 22 of the conductive member.

Figure 6:
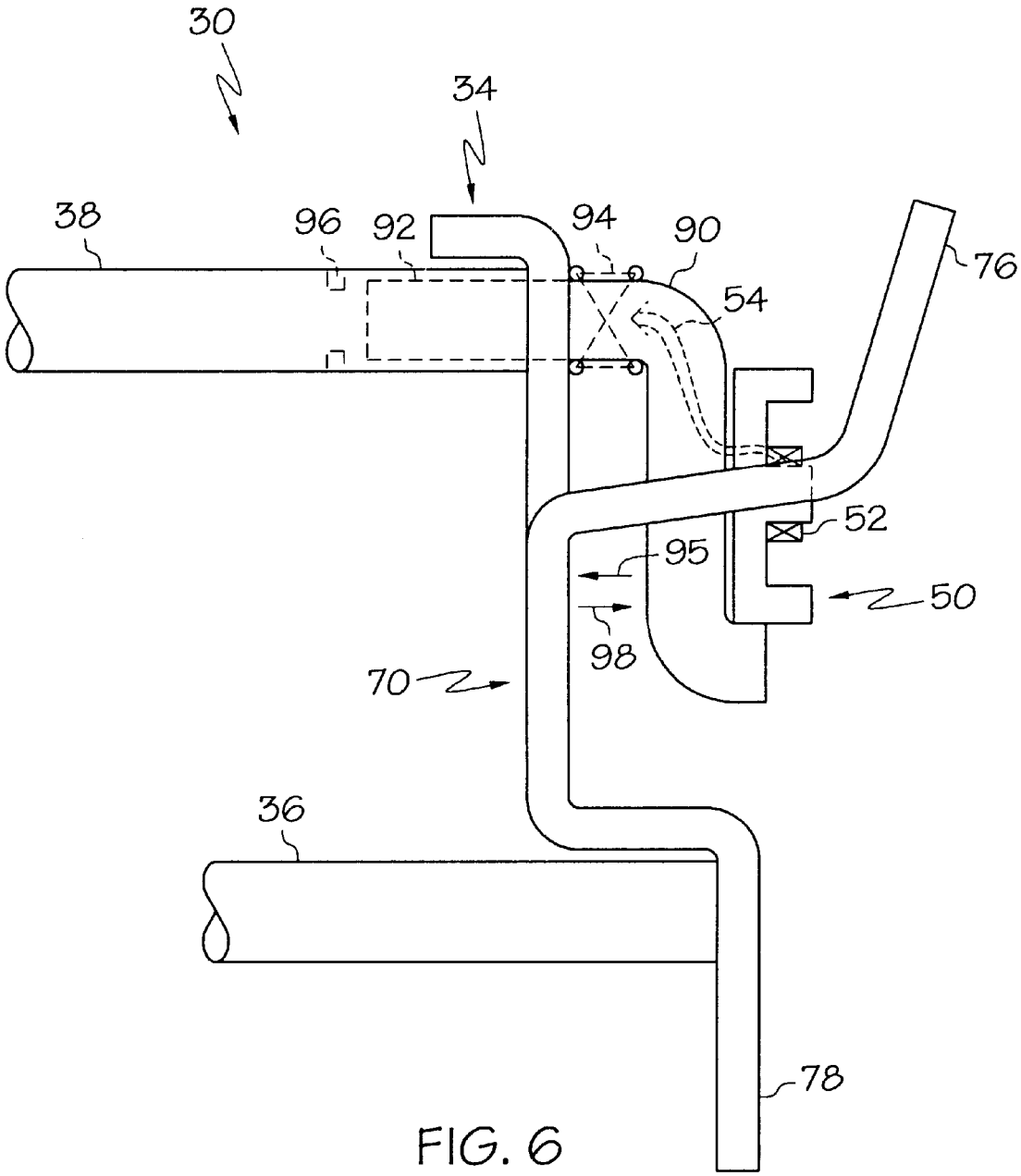
FIG. 6 is a partial side elevation view of the rear end of the peg hook frame of FIG. 4, incorporating another embodiment of a magnetic core mount structure.
Figure 8:
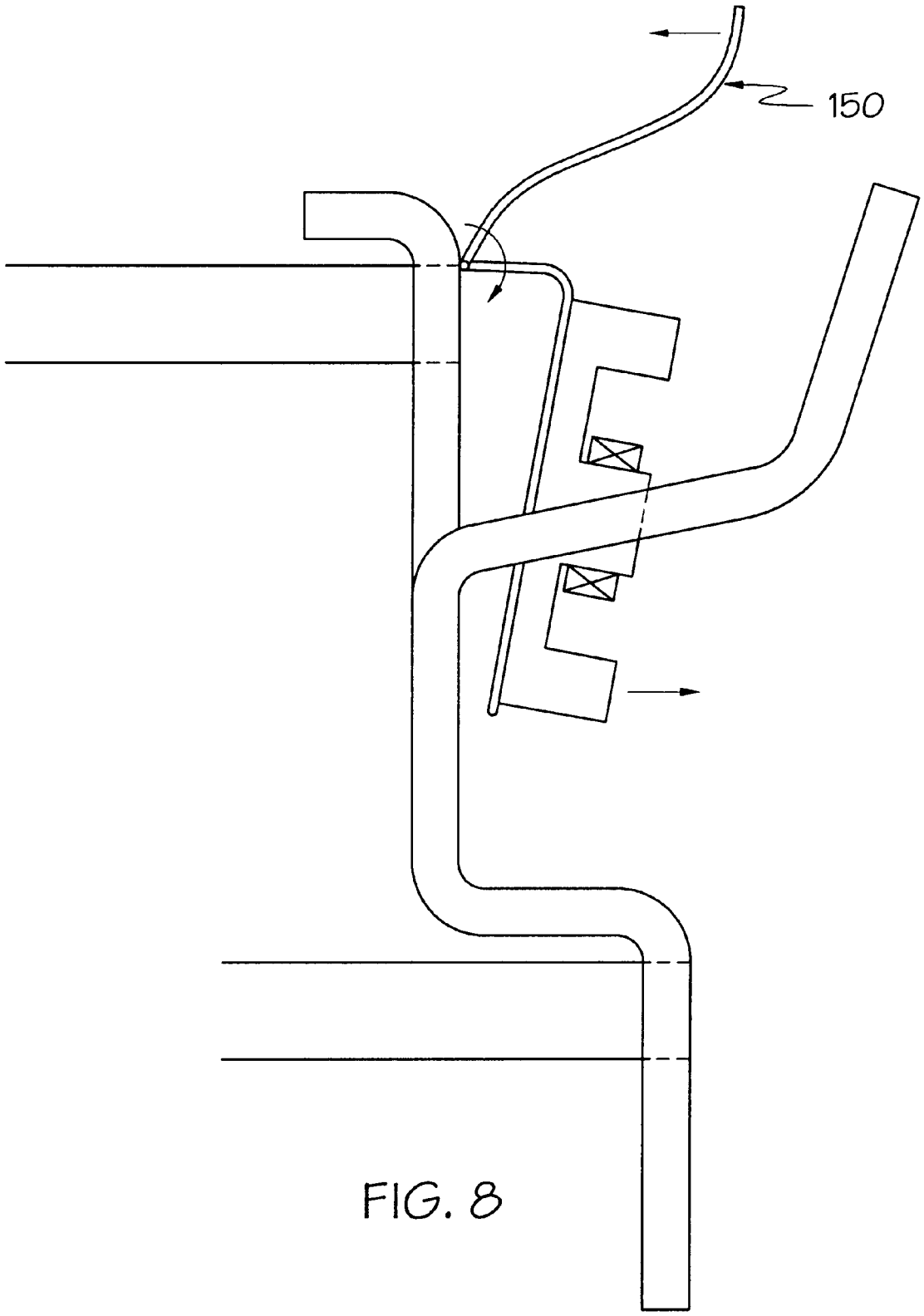
FIGS. 8 and 9 show alternative coil urging mechanisms.
Figure 9:
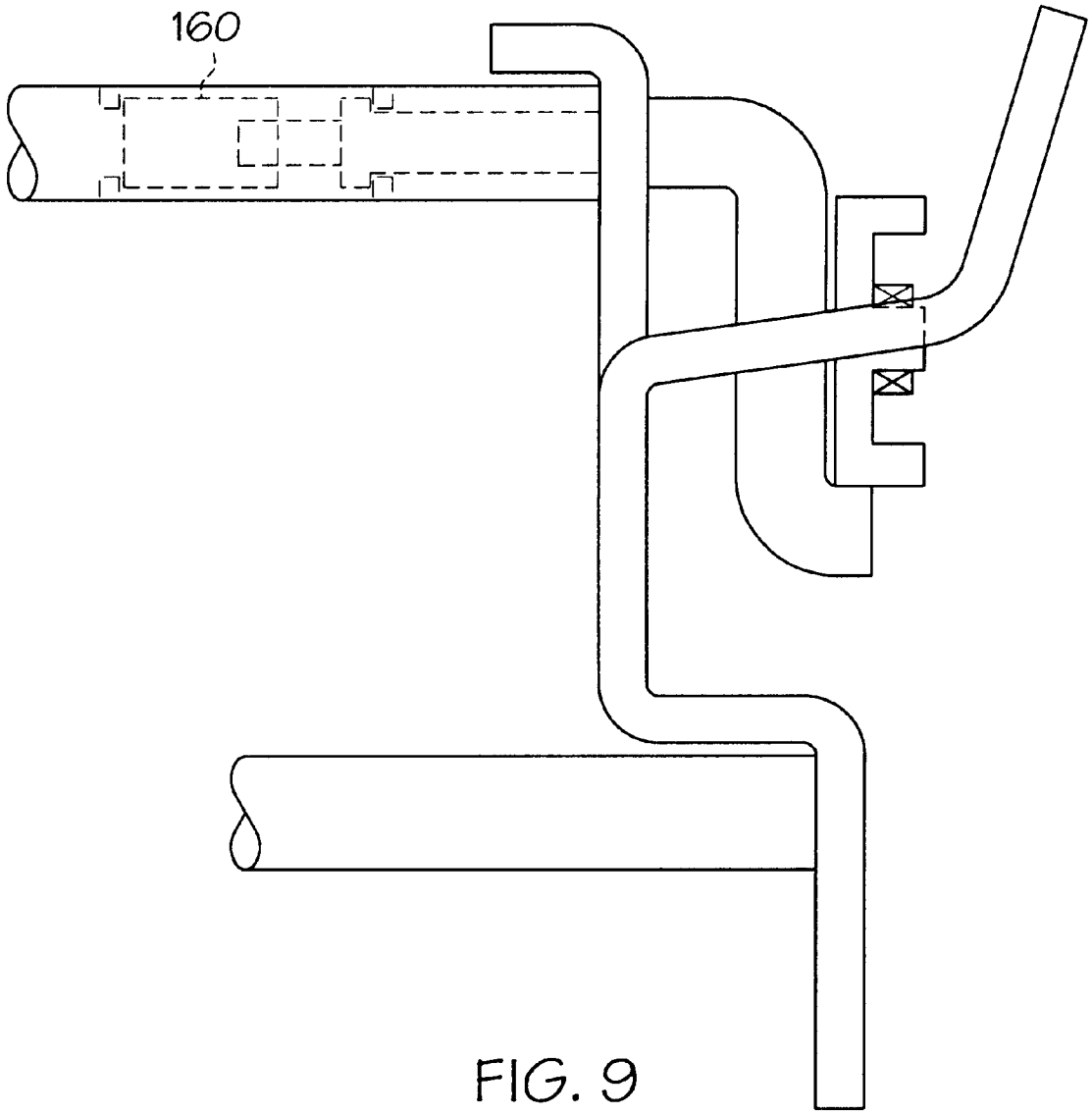

In an alternative embodiment, shown in FIG. 6, the magnetic core 50 is secured to a mount shaft 90 which in this embodiment bends downward as shown. A front end of the mount shaft 90 extends into the rear opening of the tubular information display support 38 as indicated by dashed line 92 to permit the mount shaft 90 to move in the frontward direction indicated by arrow 95. Internal stops 96 may be located within the tubular information display support 38 to limit the frontward movement of mount shaft 90. A compression spring 94 is positioned about the mount shaft 90 and contacts the rear surface of the mounting bracket 70 for urging the mount shaft in the rearward direction indicated by arrow 98. It is also anticipated that the compression spring 94 could be disposed within the tubular information display support 38 between the stops 96 and the front end of mount shaft 90. Still further, although the leaf spring structure and compression spring structure represent preferred structures for urging the magnetic core in the rearward direction toward the mounting panel 12 upon attachment of the peg hook frame 30 to the mounting panel 12, it is recognized that other structures may be suitable for the same purpose. For example, a lever-type mechanism which contacts the mounting panel and pivots the magnetic core 50 toward the mounting panel could be utilized as shown in FIG. 8, or a compressible piston-type member 160 could be utilized in a manner similar to the compression spring 94 as shown in FIG. 9. It is also recognized that a coil might be provided without a magnetic core, in which case the coil alone could be urged in the rearward direction toward the mounting panel for positioning nearby the conductive member with which inductive coupling is desired.

Figure 7:
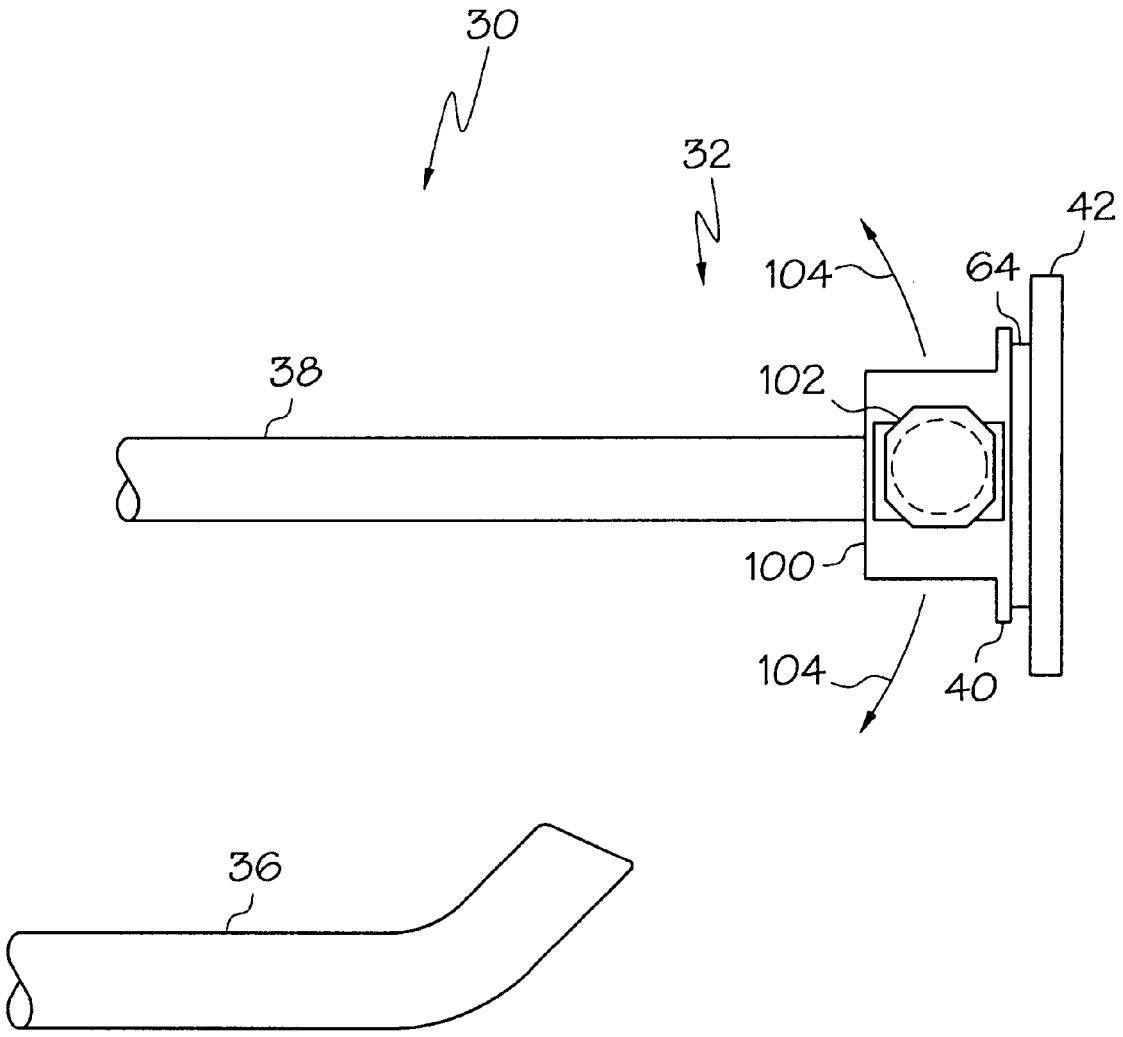
FIG. 7 is a partial side elevation view of an alternative embodiment of the front end of the peg hook frame utilized in the display system of FIG. 1.

For another aspect of the present invention reference is made to FIG. 7 in which the front end 32 of the peg hook frame 30 is shown in partial side elevation. In particular, in this embodiment the attachment surface 40 is formed on a bracket 100 which is pivotally mounted to the front end of information display support 38, such as through the use of a bolt 102 which passes therethrough and is sufficiently tight to hold the bracket 100 in place unless the bracket 100 is manually rotated or pivoted as indicated by arrows 104. Accordingly, this structure facilitates positioning of the peg hook frame at any location on a given mounting panel 12, particularly at both high and low locations. The bracket 100 can be manually pivoted to establish a display angle of the attachment surface 40 and display tag 42, such display angle being selectable as an upward display angle in cases where the peg hook frame 30 is positioned substantially lower than the average customer's point of visible perception and such display angle being selected as a downward display angle in cases where the peg hook frame 30 is positioned substantially higher than the average customer's point of visual perception. Other structures for pivotally mounting the display tag 42 to the peg hook frame 30 could also be utilized. The combination peg hook frame and pivotally mounted electronic display tag provides the display angle selection advantage with other types of electronic display tags, including those which utilize RF type communication with a controller rather than inductive communication.

While the forms of the apparatus herein described constitute preferred embodiments of the invention, it is to be understood that the present invention is not limited to these precise forms and that changes may be made therein without departing from the scope of the invention. For example, while the attachment hooks are shown on an upper portion of the peg hook frame, such attachment hooks could similarly be located toward the bottom of such peg hook frame. Likewise, while the leaf spring and compression spring are shown and described on an upper portion of the peg hook frame in association with the information display support, such structures could be positioned elsewhere on the rear portion of the peg hook frame.

What is claimed is:

1. A display system adapted for use in combination with an electronic display tag to inductively communicate signals thereto, comprising:

a mounting panel having a plurality of openings therein forming at least one line of spaced openings;

a conductor positioned adjacent the mounting panel and extending along at least a portion of the line of spaced openings; and an elongated peg hook frame having a front end and a rear end, the rear end of the peg hook frame including at least one hook-type member positioned within one of the spaced openings of the mounting panel, the rear end of the peg hook frame including a coil positioned proximate to the conductor for inductive coupling therewith.

2. The display system of claim 1 wherein the coil includes an associated magnetic core for increasing the inductive coupling between the coil and the conductor, the coil including leads which extend toward the front end of the peg hook frame.

3. The display system of claim 2 wherein the leads extend within a portion of the peg hook frame.

4. The display system of claim 2 further comprising an electronic display tag attached to the front end of the peg hook frame, the electronic display tag including a display screen for displaying product information, and the leads extending from the coil being attached to an input of the electronic display tag.

5. The display system of claim 4 wherein the conductor comprises a pair of spaced conductors encased within an electrically insulating material, a plurality of openings through the insulating material being positioned in a region between the spaced conductors, at least some of the openings through the insulating member aligned with corresponding openings in the mounting panel, the hook-type member positioned through one of the openings through the insulating material.

6. The display system of claim 4 further comprising a double-sided adhesive member for securing the electronic display tag to the peg hook frame.

7. The display system of claim 4 wherein the electronic display tag is pivotally mounted to the peg hook frame to permit selection of a display angle of the electronic display tag according to the position of the peg hook frame on the mounting panel.

8. The display system of claim 2 wherein the conductor comprises a pair of spaced conductors encased within an electrically insulating material, a plurality of openings through the insulating material being positioned in a region between the spaced conductors, the magnetic core comprising a base and at least one prong extending therefrom, the prong positioned near at least one of the spaced conductors.

9. The display system of claim 8 wherein the magnetic core includes first, second, and third prongs extending from the base, an end of the third prong positioned between the spaced conductors, an end of the first prong positioned adjacent to an outer side of a first one of the spaced conductors, and an end of the third prong positioned adjacent to an outer side of a second one of the spaced conductors.

10. The display system of claim 2 further comprising means for urging the magnetic core toward the mounting panel upon attachment of the peg hook frame to the mounting panel.

11. The display system of claim 10 wherein the urging means is selected from the group consisting of a leaf spring, a compression spring, a piston member, and a lever.

12. A product support and electronic product information display device adapted for attachment to a mounting panel having a plurality of mount openings therein, comprising:

an elongated peg hook frame having a front end and a rear end, the elongated peg hook frame including an elongated product support having a front end adapted to receive products for support and display thereof, the elongated peg hook frame including an elongated information display support having an electronic display tag positioned at a front end thereof, the electronic display tag including a display screen for displaying product information, the rear end of peg hook frame including at least one hook-type member for positioning within one of the mount openings of the mounting panel to support the peg hook frame therefrom, the rear end of the peg hook frame including a magnetic core having a coil wound thereabout for inductively receiving signals, leads from the coil extending to the electronic display tag for providing inductively received signals thereto.

13. The device of claim 12 wherein the information display support comprises a hollow member, the leads from the coil passing within the information display support along at least a portion of a length of the information display support.

14. The device of claim 12 further comprising means for urging the magnetic core toward the mounting panel upon attachment of the peg hook frame to the mounting panel.

15. The device of claim 12 further comprising a leaf spring having a first end mounted to a rear portion of the peg hook frame, the magnetic core mounted to the leaf spring toward a second end thereof.

16. The device of claim 12 further comprising a mounting shaft having a first end positioned within an opening at the rear end of one of the information display support and the product support, the electronic display tag mounted toward a second end of the mount shaft, and a compression spring positioned for urging the mounting shaft in a rearward direction.

17. A product support and electronic product information display device adapted for attachment to a mounting panel having a plurality of mount openings therein, comprising:

an elongated peg hook frame having a front end and a rear end;

a receiving coil positioned at the rear end of the peg hook frame for inductively receiving signals;

an electronic display tag attached toward the front end of the peg hook frame; and at least one lead extending from the receiving coil to the electronic display tag to provide inductively received signals thereto.

18. The device of claim 17 wherein the receiving coil includes an associated magnetic core, the receiving coil positioned about a magnetic path at least partially defined by the magnetic core.

19. The display system of claim 17 further comprising means for urging the coil toward the mounting panel upon attachment of the peg hook frame to the mounting panel.

20. A display system adapted for use in combination with an electronic display tag to inductively communicate signals thereto, comprising:

a mounting panel having a plurality of openings therein forming at least one line of spaced openings;

an insulated conductor positioned adjacent the mounting panel and extending along at least a portion of the line of spaced openings; and an elongated peg hook frame having a front end and a rear end, the rear end of the peg hook frame including at least one hook-type member positioned within one of the spaced openings of the mounting panel, the rear end of the peg hook frame including a coil positioned adjacent the conductor in a non-conductive relationship therewith, the coil positioned sufficiently close to the conductor to have signals electromagnetically induced therein when electrical signals are passed through the conductor.

21. A product support and electronic product information display device adapted for attachment to a mounting panel having a plurality of mount openings therein, comprising:

an elongated peg hook frame having a front end and a rear end, the elongated peg hook frame including an elongated product support having a front end adapted to receive products for support and display thereof, the elongated peg hook frame including an elongated information display support having an electronic display tag positioned at a front end thereof, the electronic display tag including a display screen for displaying product information, the rear end of peg hook frame including at least one hook-type member for positioning within one of the mount openings of the mounting panel to support the peg hook frame therefrom, the rear end of the peg hook frame including a coil for inductively receiving signals, leads from the coil extending to the electronic display tag for providing inductively received signals thereto, and means for urging the coil toward the mounting panel upon attachment of the peg hook frame to the mounting panel.

* * * * *